US012221881B2

(12) United States Patent
Toniolo

(10) Patent No.: US 12,221,881 B2
(45) Date of Patent: Feb. 11, 2025

(54) CONVEYANCE APPARATUS, SYSTEMS, AND METHODS

(71) Applicant: Schlumberger Technology Corporation, Sugar Land, TX (US)

(72) Inventor: Julien Toniolo, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 201 days.

(21) Appl. No.: 17/629,478

(22) PCT Filed: Jul. 23, 2020

(86) PCT No.: PCT/US2020/043246

§ 371 (c)(1),
(2) Date: Jan. 24, 2022

(87) PCT Pub. No.: WO2021/016443

PCT Pub. Date: Jan. 28, 2021

(65) Prior Publication Data

US 2022/0268151 A1 Aug. 25, 2022

Related U.S. Application Data

(60) Provisional application No. 62/878,166, filed on Jul. 24, 2019.

(51) Int. Cl.

| | |
|---|---|
| ***E21B 47/18*** | (2012.01) |
| ***E21B 23/03*** | (2006.01) |
| ***E21B 47/06*** | (2012.01) |
| ***E21B 47/09*** | (2012.01) |
| *E21B 23/08* | (2006.01) |

(52) U.S. Cl.
CPC ..... *E21B 47/18* (2013.01); *E21B 23/03* (2013.01); *E21B 47/06* (2013.01); *E21B 47/09* (2013.01); *E21B 23/08* (2013.01)

(58) Field of Classification Search
CPC ..... E21B 23/03; E21B 23/10; E21B 23/12; E21B 47/18; E21B 47/22; E21B 47/24
See application file for complete search history.

(56) References Cited

U.S. PATENT DOCUMENTS 3,964,556 A 6/1976 Gearhart et al.
5,560,437 A 10/1996 Dickel et al.
(Continued)

FOREIGN PATENT DOCUMENTS

EP 3205812 A1 8/2017
WO 2014105049 A1 7/2014

OTHER PUBLICATIONS

International Preliminary Report on Patentability issued in PCT Application PCT/US2020/043246 dated Feb. 3, 2022, 11 pages.
(Continued)

*Primary Examiner* — Tara Schimpf
*Assistant Examiner* — Lamia Quaim
(74) *Attorney, Agent, or Firm* — Jeffrey D. Frantz

(57) ABSTRACT

An apparatus can have a seal module located at an upper portion thereof. The apparatus can also have a mud line formed through the upper portion of the apparatus and a mud outlet in fluid communication with the mud line. The apparatus can also include a mud pulser adjacent the mud outlet, wherein the mud pulser is configured to be actuated to open, partially close, and close the mud outlet.

14 Claims, 9 Drawing Sheets

(56) References Cited

U.S. PATENT DOCUMENTS

| | | | | |
|---|---|---|---|---|
| 5,636,178 | A | 6/1997 | Ritter | |
| 6,170,573 | B1 | 1/2001 | Brunet et al. | |
| 2007/0188344 | A1 | 8/2007 | Hache et al. | |
| 2008/0156477 | A1* | 7/2008 | Aivalis | E21B 41/0085 166/53 |
| 2010/0328095 | A1 | 12/2010 | Hawthorn | |
| 2011/0011594 | A1* | 1/2011 | Young | E21B 47/18 175/48 |
| 2013/0249703 | A1 | 9/2013 | Hawthorn et al. | |
| 2018/0371899 | A1 | 12/2018 | Switzer et al. | |
| 2020/0217148 | A1* | 7/2020 | Massey | E21B 17/023 |

OTHER PUBLICATIONS

Extended Search Report issued in European Patent Application No. 20844488.5 dated Jul. 21, 2023, 7 pages.

International Search Report and Written Opinion issued in PCT Application PCT/US2020/043246, dated Oct. 30, 2020 (15 pages).

First Office Action issued in China Patent Application No. 202080064304.8 dated Jan. 31, 2024, 13 pages with English translation.

Communication Pursuant to Article 94(3) issued in European Patent Application No. 20844488.5 dated Mar. 11, 2023.

Second Office Action issued in China Patent Application No. 202080064304.8 dated Jul. 7, 2024, 10 pages with English translation.

* cited by examiner

CONVEYANCE APPARATUS, SYSTEMS, AND METHODS

CROSS-REFERENCE TO RELATED APPLICATIONS

This application is a national stage entry under 35 U.S.C. 371 of International Application No. PCT/US2020/043246, filed on Jul. 23, 2020 and titled "CONVEYANCE APPARATUS, SYSTEMS, AND METHODS", which claims the benefit of and priority to U.S. Provisional Application Ser. No. 62/878,166, filed Jul. 24, 2019, and titled "CONVEYANCE APPARATUS, SYSTEMS, AND METHODS", which is incorporated herein by this reference in its entirety.

BACKGROUND

This disclosure generally relates to apparatus, systems, and methods to convey a tool string into a wellbore. Conveyance of tool strings often requires several pieces of equipment including a winch, cable, pulley system, and other wireline surface equipment to convey a wireline tool string into a wellbore; however, deployment and setup of the wireline surface equipment is often time consuming and inefficient.

Therefore, a need exists for apparatus, systems, and methods to convey a tool string into a wellbore that reduces the amount of surface equipment required to convey the tool string into the wellbore.

SUMMARY

A method of conveying a logging tool into a wellbore. The method can include placing an apparatus into a drill pipe in a wellbore, wherein the apparatus is configured to be conveyed by mud pumping into the drill pipe. The method can also include adjusting a mud pulser on the apparatus to selectively open or close a mud outlet in the apparatus. The method can also include landing the apparatus in a landing portion.

A system for conveying a tool string into a wellbore can include an apparatus as disclosed herein. The system can also include a logging tool string connected with a lower portion of the apparatus. The system can also include a drill pipe having a landing portion at a lower end thereof.

In an embodiment, the apparatus can include a seal module located on an upper portion of the apparatus. The apparatus can also have a lower portion configured to connect to a tool string, and the apparatus can be configured to communicate with the surface.

In another embodiment, the apparatus can include a seal module located at an upper portion thereof and a mud line formed through the upper portion of the apparatus. The apparatus can also include a mud outlet in fluid communication with the mud line. The apparatus can also include a mud pulser adjacent the mud outlet, wherein the mud pulser is configured to be actuated to open, partially close, and close the mud outlet. The apparatus can also include a mud pulser harness connected with the apparatus between the mud pulser and a swivel, wherein the mud pulser harness is connected with the mud pulser and the swivel. The apparatus can also include a control module adjacent the swivel, wherein the swivel provides communication between the control module and the mud pulser harness.

A BRIEF DESCRIPTION OF THE DRAWINGS

Various aspects of this disclosure may be better understood upon reading the following detailed description and upon reference to the drawings in which.

DETAILED DESCRIPTION

Figure 1:
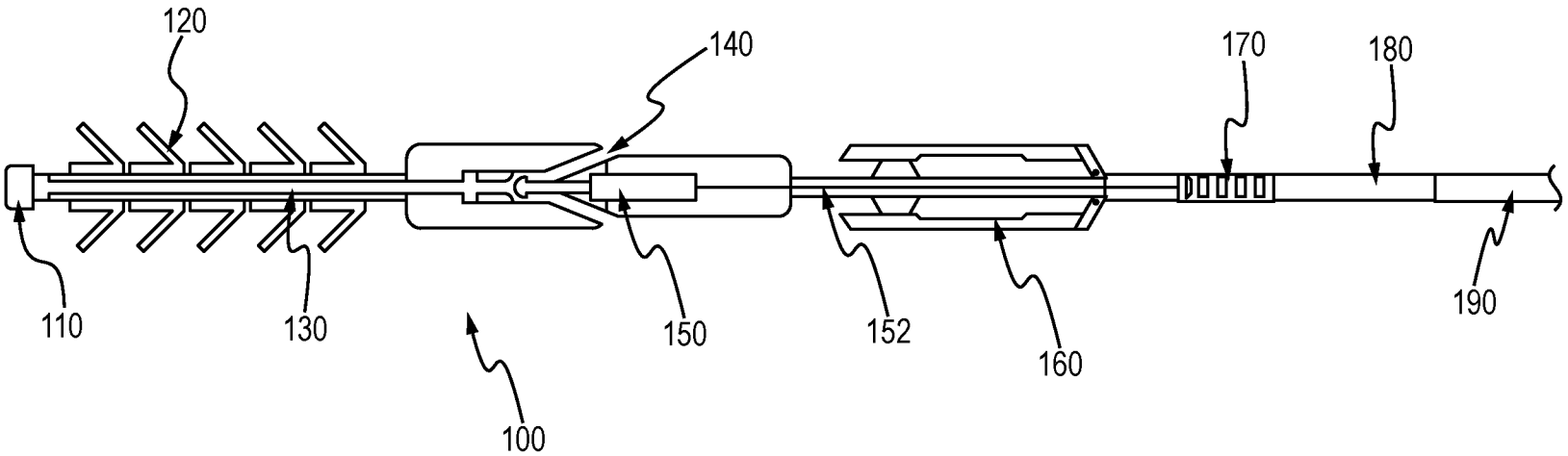
FIG. 1 depicts an example of an apparatus for conveying a tool string.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would be a routine undertaking of design, fabrication, and manufacture for those of ordinary skill having the benefit of this disclosure.

In one or more embodiments a method of conveying a tool string into a wellbore can include placing an apparatus with a tool string attached to an end thereof into a drill pipe in wellbore. The apparatus can be used to convey an attached tool string into the wellbore without a tether to surface equipment, thereby allowing a tool string to be conveyed without additional surface equipment and using standard equipment of a rig that is used to run pipe into the wellbore, drill the wellbore, or combinations thereof. To accomplish this the apparatus is configured to be pumped down, using a standard mud pump used in typical drilling operations, in a controlled manner.

The method can also include providing data to the surface. The data can be provide to the surface using mud pulse telemetry, electromagnetic telemetry, other types of telemetry or combinations thereof.

In one or more embodiments of the method the telemetry can be mud pulse telemetry and the method can further include adjusting a mud pulser on the apparatus to selectively open, partially close, or close a mud outlet in the apparatus. The selective operation of the mud pulser allows for data to be conveyed to the surface for viewing or storage. The data acquired and sent to the surface during conveyance of the apparatus, using the mud pulse communication, can include tool health data, conveyance data, wellbore condition data, formation data, evaluation data, or combinations thereof. The tool health data can be the status of a power supply in communication with the tool string, status of components of the tool string, or the like. The conveyance data can used depth, acceleration data, conveyance speed data, or the like. The wellbore condition data can include pressure, temperature, or the like. In one or more embodiments, the conveyance data can include data from one or more accelerometers on the tool string or apparatus, for example, one or more three axis accelerometers can be placed on various locations of the apparatus and tool string, the data can be uplinked to the surface using the selective actuation of the mud pulser following a communication scheme, and rig sensors, for example a sensor configured to measure standpipe pressure, can take the mud pulse data and send it to the rig system, and an external system can be linked to the rig system. The external system can include one or more processors configured by computer instructions in communication with the processors to convert the accelerator data into velocity (i.e., integrate the accelerator data over time), and position (i.e., integrate the velocity data over time), and display the velocity and position of the apparatus on a display. The processor can also be configured to form a trace of the apparatus path of travel and provide into a map or model of the wellbore that was created during drilling to help fine tune the map or model, issue an alert if the axial velocity is over a predetermined value, issue an alert if lateral velocity or acceleration is detected or above a predetermined value, issue a command to the rig system to adjust the mud pump rate if the velocity is over a predetermined value or below a predetermined value, issue an alert if upon detection of the displacement of the tool string is such that it is approaching the landing portion of the drill pipe, determine using accelerator data and displacement value to detect that the apparatus is landed in the in the landing portion of the drill pipe, and confirm, adjust, or combinations thereof the depth data of the landing portion using the displacement data when the apparatus is confirmed landed in the landing, other determinations by processing the sensor data on the apparatus or tool string to determine a desired value. The apparatus can also include sensors to detect the shock or force imparted to the apparatus when the apparatus lands in the landing portion. In one more embodiments, the shock or force imparted to the apparatus during landing can with a model of the tool in communication with the one or more processors to predict the health of the tools, simulate the actions at landing to determine if there is potential damage to any of the components, or predict how many more landings the apparatus can take before needing maintenance, or the like.

The mud pulser can be selectively operated, as described in more detail below, to send data to the surface. The data can include tool string health data, evaluation data collected using one or more formations evaluation sensors or fluid testing sensors on the tool string, operation data, or combinations thereof. In one or more embodiments, the operation data can be a signal the memory is recording evaluation data, motor torque, pump pressure, actuation of an anchor or evaluation pad, the movement of a mechanical intervention or coring bit; test pressure of a formation evaluation tool, weight on bit of a coring bit, or other operation data. Tool string health data can be signal indicating all major components passed an operation check, a signal that something is not connected, or other tool string health data.

In one or more embodiments, the telemetry can be electromagnetic telemetry. The electromagnetic telemetry can use now known electromagnetic telemetry systems or future known electromagnetic telemetry. For example, the electromagnetic telemetry can use the TelePacer™ modular MWD platform with Express™ electromagnetic telemetry available from Schlumberger™.

In one or more embodiments, the method can include acquiring evaluation data as the apparatus and tool string are being conveyed to detect increase in density, thereby indicating that the apparatus is passing a drill pipe joint, and deriving the speed and location of the tool string during conveyance. The evaluation data can be acquired using a logging tool string, casing collar locator, or combinations thereof. For example, radioactive measurement such as gamma measurements, neutron-gamma measurements, X-ray measurements, the like, or combinations thereof. The method can also include sending the evaluation data to the surface and modulating mud flow rate in the bore to optimize the conveyance of the tool string.

In one or more embodiments, the method can include acquiring evaluation data during conveyance to detect changes in density, process the acquired data downhole to determine apparatus speed, location, or combinations thereof, transmit the determined speed, location, or combinations thereof to the surface, and modulate the mud pump rate to the borehole based on the determine location, speed, or combinations thereof. The method may further includes processing the evaluation data downhole to determine the speed, location, or combinations thereof and sending the determined speed, location, or combinations thereof to the surface. In one or more embodiments, the determined speed, location, or combinations thereof is used to automatically modulate the mud pump flow rate. For example, the surface equipment can have a processor and data acquisition system configured to receive the determined speed, location, or combinations thereof and the processor can be in communication with computer instructions that take the determined speed, location, or combinations thereof and automatically determines the optimized pump rate and controls the mud pumps to modulate the pump rate to the optimized pump rate. The optimized pump rate can be determined by predetermined values based on the location, speed, or the like. For example, the computer instructions can include or be in communication with a planner that says at x depth the speed should be n, if the speed of the apparatus at x depth is greater than n the computer instructions would instruct the processor to calculate the pump rate that will reduce the speed to match n and control the mud pumps to adjust the pump rate accordingly, and if the speed of the apparatus at x depth is less than n the computer instructions would instruct the processor to calculate the pump rate that will increase the speed to match n and control the mud pumps to adjust the pump rate accordingly.

In one or more embodiments, the method can include providing automated pump rate control based on downhole tool speed. The tool speed can be determined from data acquired from casing collar locaters, wheels on the apparatus or tool string, accelerometers on the apparatus or tool string, and pressure drop along tool string In one or more embodiments, the pressure drop can be determined using pressure gauges located at upper portion and lower portion of the apparatus and tools string. The pressure difference between both values is equal to the pressure drop in the drill pipe between both points of the tool string. This can give us an indication of the pumping efficiency.

The control module described in more detail below can include one or more additional modules which can be connected and in communication with one another. In one or more embodiments, the control module or a module in communication with the control module can be configured to provide conveyance monitoring and decision processing. The conveyance monitoring and decision processing will receive input from: a casing collar locator, one or more accelerometers, one or more wheels contacting the drill pipe ID, a top pressure gauge, a bottom pressure gauge, or combinations thereof. A processor in the module will be configured by computer instruction in communication with the processor to process the data to derive downhole speed while deploying during pump down, and the pressure drop along the string. The derived speed and pressure drop can be used to determine a recommended pump rate. The recommended pump rate can be communicated to the surface using telemetry. For example, the recommend pump rate can be communicated to surface using mud pulse temerity. Any type of mud pulse communication protocols can be used to communicate the recommended pump rate to the surface. For example, a pressure pulse every minute when the tool string speed is close to the desired pump down speed; increased pressure pulse frequency when the tool string speed is above the desired pump down speed; a decreased pressure pulse frequency when the tool string speed is below the desired pump down speed; the like; or combinations thereof. The pressure pulses are interpreted at surface and the pump rate is adjusted by modulating the pump rate or diverting a portion of the flow.

Furthermore, the top pressure sensor and bottom pressure sensor measurements can be matched against each other with the knowledge of deviation, mud density, and distance between sensors, or when deviation is 90 degrees. The pressure sensors can be used to derive pressure drop along the string (indication of force exerted by the flow onto the string); receive downlink mud pump commands; shut down the tools after the interval is completed before the tool strings reaches the surface; or combinations thereof.

FIG. 1 depicts an example of an apparatus 100 for conveying a tool string. The apparatus 100 includes a retrieval neck 110, one or more seal modules 120, one or more mud lines 130, one or more mud outlets 140, one or more mud pulsers 150, one or more mud pulser harnesses 152, one or more decelerators 160, one or more swivels 170, and one or more control modules 180.

The retrieval neck 110 is located at an end of the apparatus 100 and a tool string 190 is connected at the other end of the apparatus 100. The retrieval neck 110 is configured to allow the apparatus 100 and tool string 190 to be retrieved via a retrieval operation if needed. The retrieval neck 110 can be any now known or future known retrieval neck. The tool string 190 can be a logging tool string, a collar locator, intervention tool string, other known or future known tools strings, or combinations thereof. Examples of logging tool strings include nuclear logging tool strings, a resistivity logging tool strings, nuclear magnetic resonance logging tool strings, dielectric logging tool strings, micro resistivity logging tool strings, x-ray logging tool strings, other now known or future known logging tool strings, or combinations thereof.

The one or more seal modules 120 are located adjacent the retrieval neck 110. The one or more seal modules 120 can be one or more wiper plugs, one or more swab cups, or one or more other device to add drag and seal on the drill pipe bore. The one or more seal modules 120 can be made from any material, such, as a flexible rubber, flexible polymer, or other flexible composite. The one or more seal modules 120 provide a seal during deployment and provide substantially positive displacement, allowing pump down conveyance with low pump rates, medium pump rates, or high pump rates. The one or more mud lines, shown as one mud line 130 provides a flow path through a top portion of the apparatus 100 to one or more mud outlets, depicted as one mud outlet 140.

One or more mud pulsers, depicted as a single mud pulser 150, can be located adjacent the mud outlet 140. The mud pulser 150 can be connected with one or more mud pulser harnesses, depicted as one mud pulser harness 152. The mud pulser harness 152 can be connected to the swivel 170. The swivel 170 can be a multi-contact swivel that provides communication between the one or more control modules, shown as control module 180. The multi-contact swivel can also accommodate rotation of the drill pipe while tripping out without cause loss of communication between the mud pulser harness 152 and control module 180. The swivel 170 can also allow the tool string 190 to self-position in the borehole wall, independent from the face of the drill pipe. The swivel 170 can have one or more rotatable electrical connections, for example one for communication signals and one for power. Accordingly, the mud pulser harness 152 can allow communication between the mud pulser 150 and the control module 180, allowing power, signals, or combinations thereof to be sent between the mud pulser 150 and control module 180. One or more decelerators can be located on the apparatus 100, one decelerator 160 is depicted disposed between the mud outlet 140 and the control module 180.

The mud pulser 150 can be any now known or future known mud pulser. In one or more embodiments, the mud pulser 150 can be a linear valve type. In one or more embodiments, the mud pulser 150 can include a plunger. The mud pulser 150 can be actuated by an actuation system. Embodiments of the actuation system are described in more detail below. Another example of the mud pulser 150 is a rotary siren mud pulser, for example the mud pulser can include a rotor working in combination with a stator to selectively at least partially restrict, fully restrict, or open the mud inlet. The mud pulser 150 can include other flow control devices such as solenoid valves or the like.

The decelerator 160 can be a mechanical device configured to be self-actuating, to be actuated from a control system, or combinations thereof. For example, the decelerator 160 can have an electric actuator that is activated by the control module 180 when data from an accelerometer is above a predetermined value or range or the like, e.g., proximity to the landing portion and velocity, or the like.

The control module 180 can include one or more communication modules, one or more power modules, one or more microprocessor, one or more communication bus, or combinations thereof. The control module 180 collects data from the other tools of the tool string 190, summarizes the data, and generates a status word under the form of a predefined pulse communication pattern.

Figure 2:
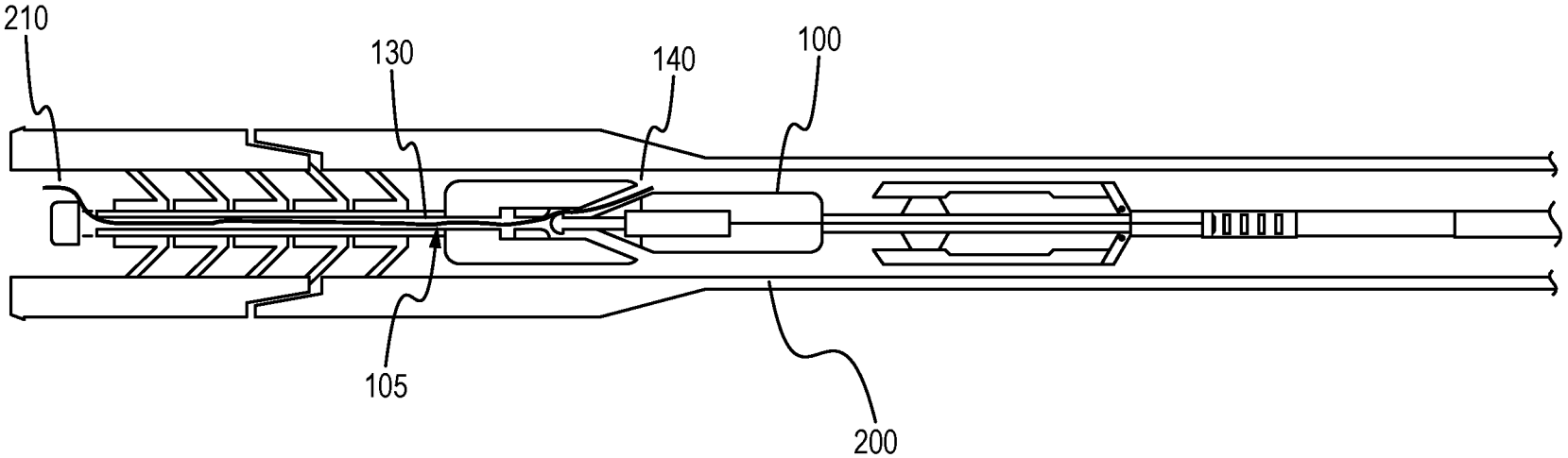
FIG. 2 depicts a schematic of the apparatus for conveying a tool string being conveyed in a drill pipe.

FIG. 2 depicts a schematic of the apparatus 100 for conveying a tool string being conveyed in a drill pipe 200. The apparatus 100 can be conveyed into a wellbore through drill pipe 200. Mud 210 can be pumped from the surface through the bore of the drill pipe 200, the mud 210 can cause the apparatus 100 to move within the drill pipe 200. The mud 210 can flow in the mud line 130 and exit the mud outlet 140. During the pump down the mud pulser 150 can be alternated to open or close the mud outlet 140 such that pressure drop in the tool can take all values between high pressure drop, i.e., tool string 190 friction force/pipe ID cross section area, and low pressure drop caused by the mud 210 flowing in the bore of the mud line 130. For example, for high pressure drop the mud pulser 150 is in a position to close the mud outlet 140 and for low pressure drop the mud pulser 150 is in a position to open the mud outlet 140.

Figure 3:
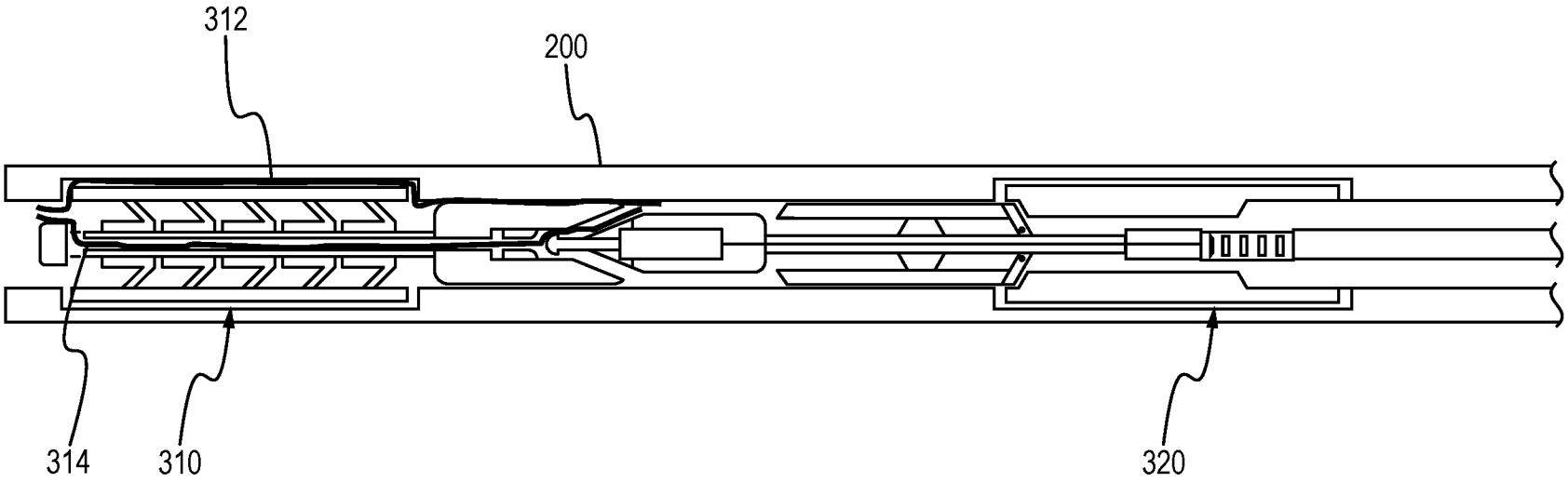
FIG. 3 depicts a schematic of the apparatus for conveying a tool string landed in a drill pipe.

FIG. 3 depicts a schematic of the apparatus 100 for conveying a tool string 190 landed in a drill pipe 200. The drill pipe 200 can have a lower landing portion that is configured to catch the apparatus 100, for example by having a landing shoulder that has an inner diameter to catch a portion of the tool. The landing portion can be connected to a lower end of the drill pipe 200, be integrated into the lower portion of the drill pipe 200, or the like. The inner profile of the landing portion can have a flow bypass 310 and 320. When the apparatus 100 is landed the seal module 120 is adjacent the flow bypass 310. The flow bypass 310 and 320 allow for pumping to continue during downhole operations even when the apparatus 100 is landed. An annulus is formed between the outer diameter of the apparatus 100 proximate to the mud pulser 150 and the inner diameter of the landing portion. In operation, when the mud pulser valve is opened, the mud 210 will flow through the mud line 130 with small pressure drop, providing the low-pressure state of communication. When the mud pulser valve is closed, the mud 210 flow through the mud line 130 is nul and the mud 210 is forced to flow through the flow bypass 310 and the annulus formed between the outer diameter of the apparatus 100 proximate to the mud pulser 150 and the inner diameter of the landing portion, this mud path creates a larger pressure drop that is the high pressure state of the communication scheme.

Figure 4:
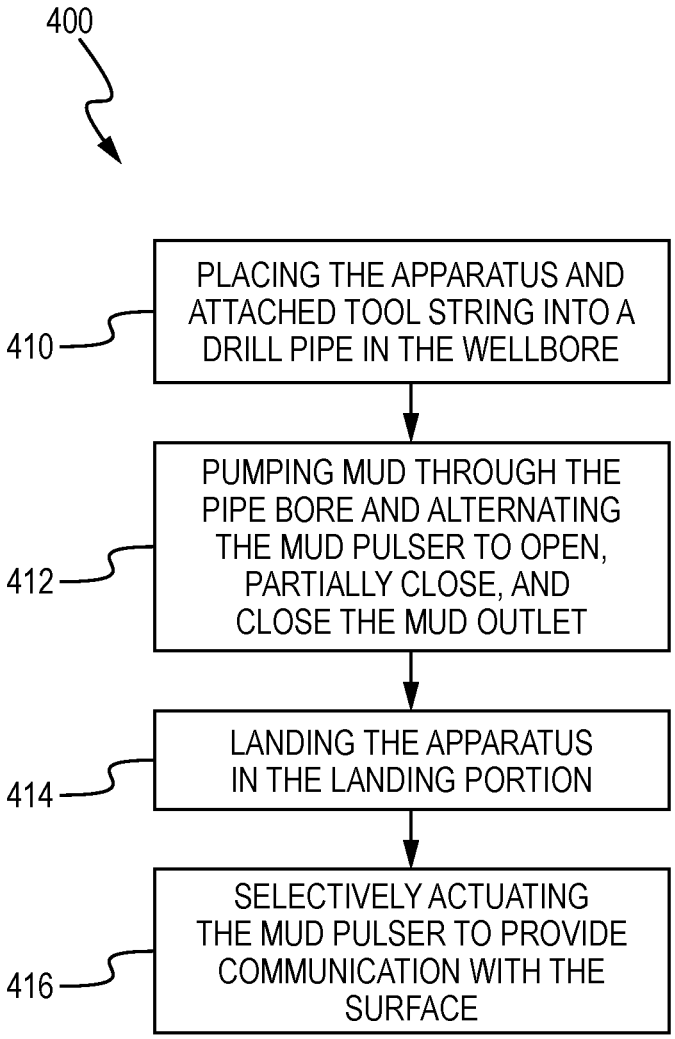
FIG. 4 depicts an embodiment of a method of conveying a tool string.

FIG. 4 depicts an embodiment of a method 400 of conveying a tool string. The method 400 includes placing the apparatus and attached tool string into a drill pipe in the wellbore at step 410. The method 400 also includes pumping mud through the pipe bore and alternating the mud pulser to open, partially close, and close the mud outlet at step 412. The method 400 also includes landing the apparatus in the landing portion at step 414. The method 400 can also include selectively actuating the mud pulser to provide communication with the surface 416. The communication scheme can be but is not limited to: a pulse width modulation between the high and low pressure drop states described above for each position. The communication scheme can allow for visual or rig slow sampling rate of standpipe pressure measurement sensors to acquire the data that is streamed in near real-time. For example, a rig may have pressure sensors connected to monitor standpipe pressure. The data from the apparatus is streamed in near real-time on the rig using data exchange standard, for example the Wellsite Information Transfer Standard Markup Language. By connecting an external computer to the rig communication system, pressure data is enabled on the rig and pressure modulation from the mud pulser can be acquired and decoded in real time.

The communication scheme can be a pulse width modulation between the high and low pressure drop states described above for each position. For example, a 15 second period means the tool string is functioning properly, while a 20 second period means the tool string has an issue.

Figure 5:
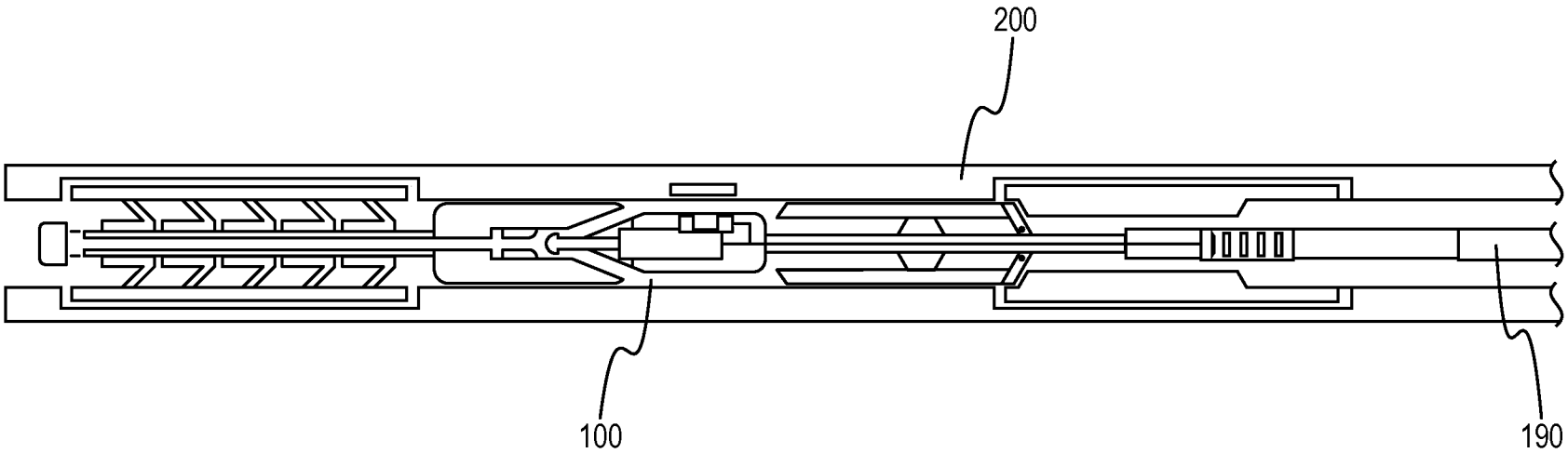
FIG. 5 depicts a schematic of the apparatus landed in the landing portion of the drill pipe, wherein the landing portion and apparatus are configured to allow landing detection.

FIG. 5 depicts a schematic of the apparatus 100 landed in the landing portion of the drill pipe 200, wherein the landing portion and apparatus 100 are configured to allow landing detection. The apparatus 100 and tool string 190 can be located within the drill pipe 200 in whole or part. For example, the apparatus 100 can be located on the landing portion of the drill pipe 200, and the tool string 190 can protrude from the drill pipe 200 into the wellbore. In another example, the apparatus 100 can be located on the landing portion of the drill pipe 200, and the tool string 190 can also be located within the drill pipe 200.

Figure 6:
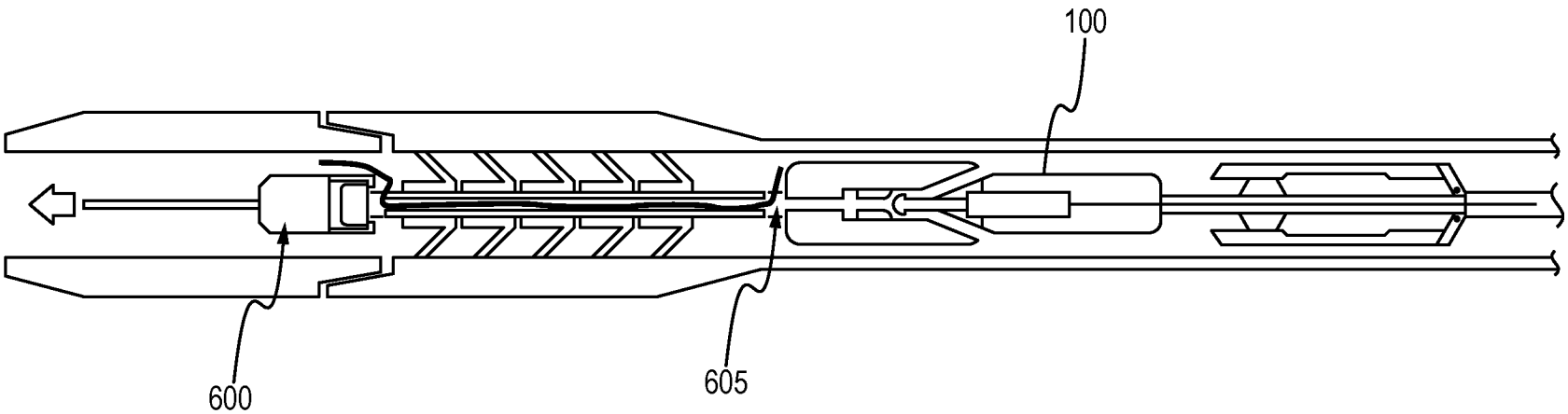
FIG. 6 depicts an embodiment of the apparatus be retrieved using a retrieval operation.

FIG. 6 depicts an embodiment of the apparatus 100 be retrieved using a retrieval operation. The apparatus 100 can be retrieved using a retrieval operation. For example, a retrieval tool 600 can be deployed into the drill pipe 200. The retrieval tool 600 can be conveyed using slickline, wireline, or the like. The retrieval tool 600 can be engaged with the apparatus 100 via the retrieval neck 110. The retrieval tool 600 can apply tension to the apparatus 100, and the tension can open a flow path 605 that will allow mud to flow out of the apparatus 100. The retrieval tool 600 can then be used to retrieve the apparatus 100. For example, the flowline can be made with coaxial and axially sliding tubes where the inner tube has side openings normally closed by being blocked by the outer tube, and can be maintained in this position by a compression spring. During pump down, the thrust is acting in the same direction as the spring and therefore the openings stay obstructed. Unlike during retrieving (no pumping) where the only force acting on the system is the retrieval tension that can overcome the spring force, that is lower than the tool string 190 buoyancy and friction, the side opening opens.

Figure 7:
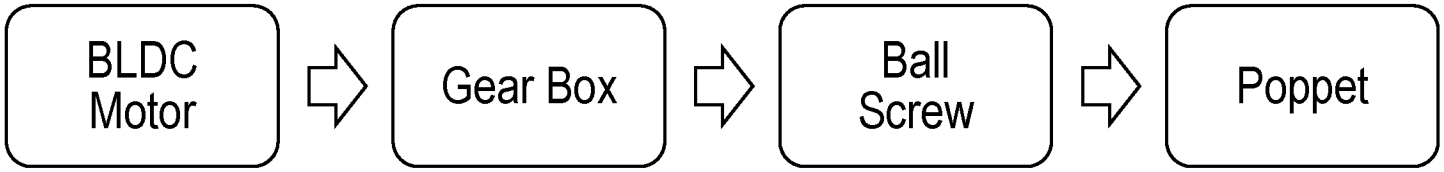
FIG. 7 depicts an embodiment of an actuation system according to one or more embodiments.

FIG. 7 depicts an embodiment of an actuation system according to one or more embodiments. The mud pulser actuation system can include a BLDC motor that is connected with a gear box, the gear box can drive a ball screw that moves the plunger position.

Figure 8:
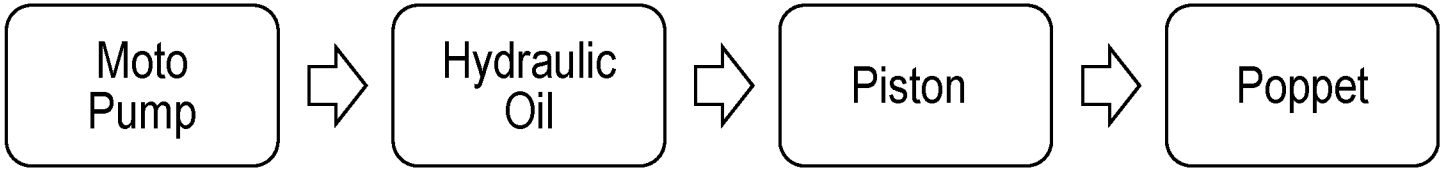
FIG. 8 depicts another embodiment of an actuation system according to one or more embodiments.

FIG. 8 depicts another embodiment of an actuation system according to one or more embodiments. The mud pulser actuation system can include a motor connected with a pump that pressurizes hydraulic oil to move a piston. The piston can move the plunger to change its position.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 9:
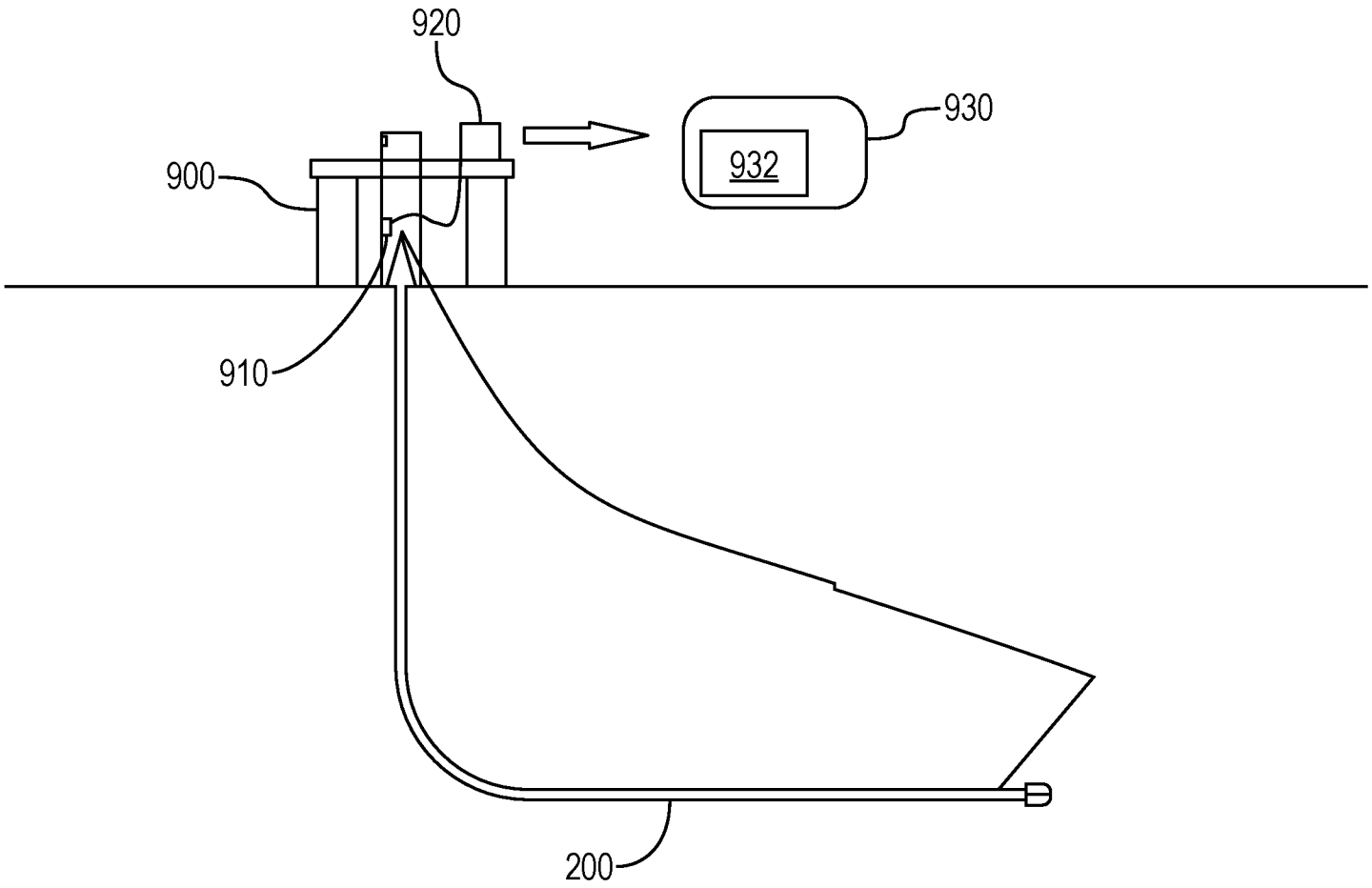
FIG. 9 depicts a schematic of a rig conveying the apparatus and attached tool string into a wellbore.

FIG. 9 depicts a schematic of a rig 900 conveying the apparatus 100 and attached tool string 190 into a wellbore. The rig 900 can be a drilling rig or other rig used to convey pipe, drill the wellbore, or combinations thereof. The rig 900 has a sensor 910 for measuring pressure in the standpipe and a rig computer system 920 that is in communication with the sensor 910. The apparatus 100 can be deployed in the drill pipe 200, and the apparatus 100, using the control module 180 to operate the mud pulser 150, can send data acquired from one or more sensors on the apparatus 100 or tool string 190 to the surface using a standard mud pulse communication protocol that is picked up by the sensor 910 and send to the rig computer system 920. An external computer system 930 is in communication the rig computer system 920. The external computer system 930 can be in the cloud, proximate the rig, or combinations thereof. The external computer system 930 can have wired communication, wireless communication, Bluetooth communication, or other types of telemetry communication with the rig computer system 920. The external computer system 930 can include one or more processors and one or more computer instructions in communication with the one or more processors. The one or more processors can be configured by the computer instructions to receive the data sent by the mud pulser from the rig computer system 920 and process the data to present one or more parameters in near real-time. Near-real time means real-time in addition to processing time, signal travel time, and other time delays typical in downhole communication and processing. The near real-time data can be displayed on one or more graphical user interfaces 932 in communication with the external computer system 930.

Figure 10:
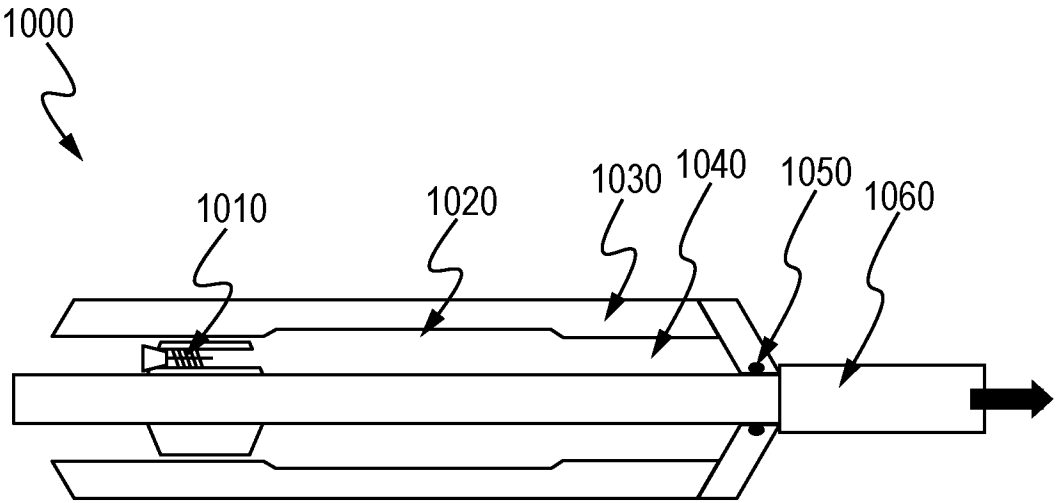
FIG. 10 depicts an embodiment of a decelerator.

FIG. 10 depicts an embodiment of a decelerator 1000.

The decelerator 1000 can have a fluid of known properties (not shown), such as hydraulic fluid, oil, grease or the like, trapped in an annular cavity 1040 whose volume varies when an outer landing sleeve 1030 moves. For example, the outer landing sleeve 1030 can slide. The outer landing sleeve 1030 can be disposed about to the apparatus 110. The apparatus 100 can have a stop 1060. The annular cavity 1040 can be sealed by one or more seals 1050.

Initially, during conveyance, the annular cavity 1040 is filled with the fluid of known properties. At landing, the internal overpressure generated by the impact of the no-go onto the sliding sleeve opens a relieve valve 1010 that allows the landing sleeve 1030 to slide and the contained hydraulic fluid to flow out.

During deceleration, the fluid of known properties is pushed out of the annular cavity 1040 thru extra grooves on the inner wall of the landing sleeve 1030. The pressure relieve valve 1010 is used to equalize the pressure between inside and outside of the annular cavity 1040 when the specific volume of the mud increases due to pressure and temperature effects. The energy absorbed during the process can be tuned by: varying the properties of fluid of known properties, the volume of fluid of known properties, or combinations thereof; varying the valve opening threshold; varying the opening size of the cuts 1020 on the landing sleeve 1030, or combinations thereof.

Although example assemblies, methods, systems have been described herein, the scope of coverage of this patent is not limited thereto. On the contrary, this patent covers every method, apparatus, and article of manufacture fairly falling within the scope of the appended claims either literally or under the doctrine of equivalents.

The invention claimed is:

1. A method of conveying a tool string into a wellbore, wherein the method comprises:

placing an apparatus, with a seal module at a first end of the apparatus and the tool string attached to a second end of the apparatus, into a drill pipe in the wellbore;

pumping mud into the drill pipe to land the apparatus in a landing portion within the drill pipe, wherein in the landing portion an annulus is formed between an outer diameter of the seal module of the apparatus and an inner diameter of the landing portion of the drill pipe;

during pumping of mud into the drill pipe, opening a mud outlet of the apparatus between the seal module and the tool string, to allow the mud to flow through one or more mud lines of the apparatus at a first pressure; and during pumping of the mud into the drill pipe, closing the mud outlet of the apparatus to prevent the mud from exiting the one or more mud lines via the mud outlet of the apparatus and to force the mud to flow through the annulus between the outer diameter of the seal module of the apparatus and the inner diameter of the landing portion of the drill pipe at a second pressure, wherein the second pressure is higher than the first pressure, and wherein the first pressure and the second pressure generate pressure pulses to provide data to equipment at a surface of the wellbore.

2. The method of claim 1, wherein the landing portion is integral with the drill pipe, connected with the drill pipe, or combinations thereof.

3. The method of claim 1, wherein the tool string is a logging tool string.

4. The method of claim 1, wherein the providing the data to the equipment at the surface of the wellbore comprises providing the data to the equipment at the surface of the wellbore in real-time according to a wellsite exchange communication standard as mud pulse data via one or more mud pulsers of the apparatus, and wherein the method further comprising using one or more rig pressure sensors to receive the mud pulse data.

5. The method of claim 1, wherein the data comprises tool health data, conveyance data, or combinations thereof.

6. The method of claim 1, wherein the providing the data to the equipment at the surface of the wellbore occurs when the apparatus is landed, and wherein the data comprises tool string health data, evaluation data, operation data, or combinations thereof.

7. The method of claim 1, wherein the apparatus is conveyed into the landing portion within the drill pipe without using a cable, a slickline, a wireline, or other tether connected to surface equipment.

8. The method of claim 1, wherein the providing the data to the equipment at the surface of the wellbore comprises providing the data to the equipment at the surface of the wellbore using mud pulse telemetry, electromagnetic telemetry, or combinations thereof.

9. The method of claim 8, wherein providing the data to the equipment at the surface of the wellbore using the mud pulse telemetry includes adjusting a mud pulser on the apparatus to at least selectively open, close, or partially close the mud outlet in the apparatus to generate the mud pulses.

10. The method of claim 1, further comprising:

acquiring evaluation data as the apparatus and tool string are being conveyed into the wellbore to detect an increase in density indicating that the apparatus is passing a drill pipe joint; and deriving a speed and a location of the tool string based on the evaluation data.

11. The method of claim 10, wherein the acquiring the evaluation data comprises acquiring the evaluation data using a logging tool string, a casing collar locator, or combinations thereof.

12. The method of claim 10, further comprising sending the evaluation data to the equipment at the surface of the wellbore, wherein the pumping the mud into the drill pipe to land the apparatus comprises modulating a mud flow rate in the wellbore to optimize the conveyance of the tool string.

13. The method of claim 10, further comprising:

processing the evaluation data downhole to determine a speed, a location, or a combination thereof; and sending the determined speed, location, or combination thereof to the equipment at the surface of the wellbore.

14. The method of claim 13, wherein the pumping the mud into the drill pipe to land the apparatus comprises automatically modulating a mud pump flow rate in the wellbore based on the determined speed, location, or combination thereof.

* * * * *